US006413173B1

(12) United States Patent
Müller et al.

(10) Patent No.: US 6,413,173 B1
(45) Date of Patent: Jul. 2, 2002

(54) MULTIPLE PURPOSE GOLF TOOL

(75) Inventors: Walter Müller, Lengnau; Carl Elsener, Ibach-Schwyz, both of (CH)

(73) Assignee: Victorinox AG, Ibach-Schwyz (CH)

( * ) Notice: Subject to any disclaimer, the term of this patent is extended or adjusted under 35 U.S.C. 154(b) by 0 days.

(21) Appl. No.: 09/432,893

(22) Filed: Nov. 8, 1999

(30) Foreign Application Priority Data

Nov. 9, 1998 (EP) ..... 98121320

(51) Int. Cl.[7] ..... A63B 57/00
(52) U.S. Cl. ..... 473/408
(58) Field of Search ..... 473/408, 406, 473/286; D21/793; 172/378; 30/155–162

(56) References Cited

U.S. PATENT DOCUMENTS

| | | | | | |
|---|---|---|---|---|---|
| 3,049,182 | A | * | 8/1962 | Pelow | 473/408 |
| 3,456,737 | A | * | 7/1969 | Rhyme | 473/408 |
| 3,539,017 | A | * | 11/1970 | Johnson | 473/408 |
| 4,539,749 | A | * | 9/1985 | Hyeong-Woon | 30/162 |
| 4,628,717 | A | * | 12/1986 | Blum | 30/162 |
| 4,856,132 | A | | 8/1989 | Burns et al. | |
| 4,998,726 | A | | 3/1991 | Budnick | |
| 5,007,129 | A | | 4/1991 | Hainey | |
| D318,625 | S | | 7/1991 | Stowell | |
| 5,054,777 | A | | 10/1991 | Borden et al. | |
| 5,099,578 | A | * | 3/1992 | Jan | 30/162 |
| 5,160,134 | A | | 11/1992 | McDonald | |
| 5,267,366 | A | | 12/1993 | Frazer | |
| 5,388,824 | A | | 2/1995 | Reimers | |
| 5,405,133 | A | | 4/1995 | Upton | |
| 5,419,551 | A | | 5/1995 | Hoyt | |
| 5,449,169 | A | | 9/1995 | Hardin et al. | |
| 5,562,553 | A | | 10/1996 | Digerness et al. | |
| 5,806,119 | A | | 9/1998 | Wood | |
| 6,217,465 | B1 | * | 4/2001 | Kenia, Jr. | 473/408 |

* cited by examiner

*Primary Examiner*—Steven Wong
(74) *Attorney, Agent, or Firm*—Pennie & Edmonds, LLP

(57) ABSTRACT

The invention relates to an especially handy and user-friendly multiple purpose tool for the sport of golf, which is light yet solidly built. Operation of the pitch fork is done with one hand, as well as the removal and insertion of the ball marker. The blade of a new kind of tee hole puncher for hard or frozen ground also serves for cleaning the flutes of the golf club. It is also combined with additional functional elements like nail files, cap openers, and the like. The economically manufacturable tool can also include, for general use, a knife blade, a scissors, a pincer, a tooth pick, a ball point pen, and other tools as the case may be.

30 Claims, 2 Drawing Sheets

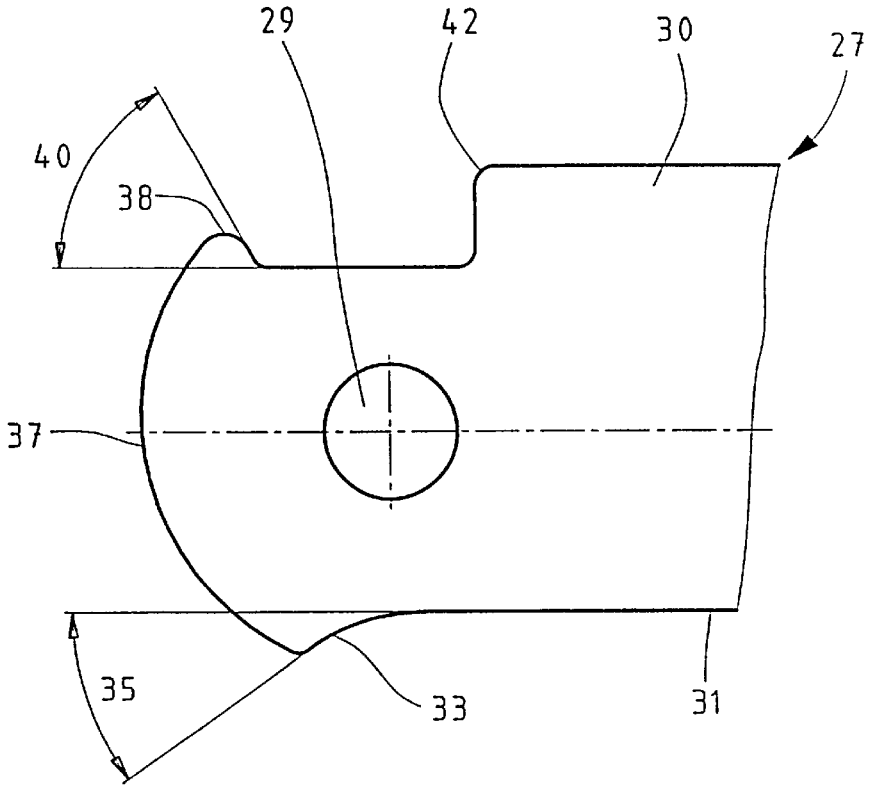
Fig.2
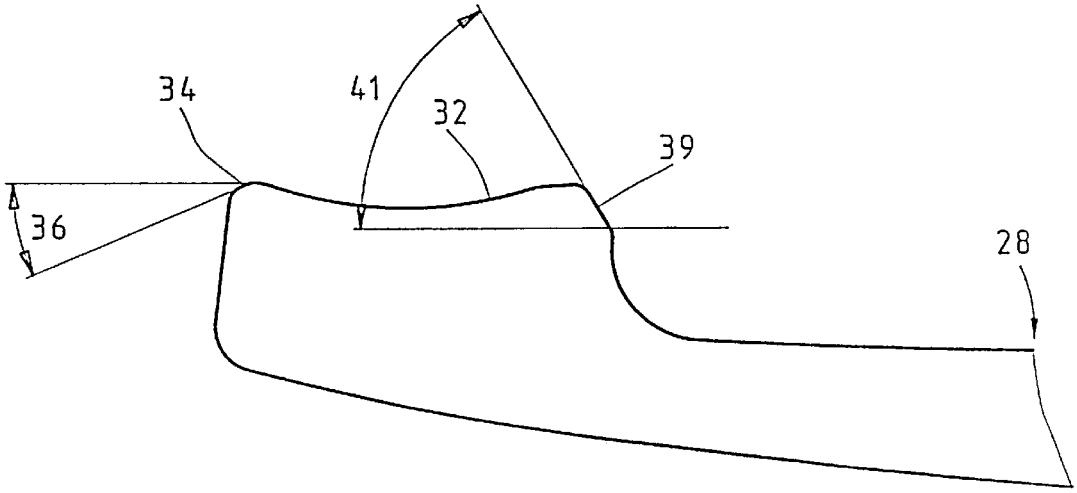

MULTIPLE PURPOSE GOLF TOOL

BACKGROUND OF THE INVENTION

1. Field of the Invention

The invention relates to a compact multiple purpose golf tool with a lengthwise body element serving as a handle and having a receptacle area for functional pieces which can be pulled out to a functional position from the handle.

2. Discussion of the Related Art

Such compact or pocket tools are known, for example pocket knives, with two opposing handle half-shells between which one or more functional pieces, such as knife blades, cork screws, screw drivers, can openers, nail files, and the like, are arranged so that they can be swung out and which are held in the collapsed or extended position basically by spring force. These are known in the most varied design forms. Thus, for example, different sizes of flat head or Phillips head screw drivers or different sizes of Allen keys or machinist's wrenches have been arranged on a pocket knife. These functional pieces are located between parallel plates, which are connected to one another by clinch bolts, with the outer plates being, covered each by one of the shells. The shells provide the visual appearance of a pocket knife, on the one hand, and are also responsible for its ergonomic properties and grip, on the other, hand. It is also known to provide the shells with push-in channels which can hold for, example, tooth picks, pincers, or cleaning needles for the spray jets of windshield washer systems on vehicles.

The equipment of pocket knives with functional pieces suitable for the most varied purposes is reflected also in the fact that known pocket knives have also been combined with a typing system. Such pocket knives are subject to high assembly expenses and therefore cause a very expensive manufacturing process.

Previously known pocket tools, especially pocket knives, usually have swingable functional elements which stick out somewhat on the side from the contour of the housing element and which are grippable with the finger tips in a way that is well-known. They are positioned in a way that they can be swung out against a spring force, so that a holding force is active both in the collapsed carrying position and in the extended functional position. This is provided by the elastic elements and cannot be controlled. Thus it may occur that the functional elements inadvertently collapse during use. Moreover, the springs become fatigued with time, which has further unfavorable effects. Another disadvantage of swingable functional elements is that they are usually swingable around one axle and thus absorb torsion forces only to a limited degree. Functional elements in previously known pocket tools cannot be opened and closed with one hand. With many special knives, the knife blade can be opened with one hand by releasing a pre-set spring, but usually they cannot be closed with one hand. Other functional elements are plugged into and can be taken out of slots in the shells or the body element.

Starting from the previously known state of technology, the present invention is based on the task, of preparing a pocket tool of the usual kind, which has different functional elements that can be used for various purposes in the sport of golf, and which is economically manufacturable and easy to use.

In particular, a tool is to be prepared in which functional elements useful for the exercise of golf are operable with one hand and can absorb leverages and torsion forces at least to the usual extent.

Beyond that, an improved control of the holding forces should be made possible, both in the carrying position and in the functional position.

For the technical solution of this task, a normal pocket tool is further developed in that a divot repair tool is arranged in the body element which can be moved by single-hand operation between a carrying position and a functional position and which can be locked in both positions.

The multiple purpose golf tool according to the invention has a divot repair tool which can be moved by single-hand operation between a carrying position and a functional position. This divot repair tool is completely housed in the body element in the carrying position and can be moved out to a functional position. Divot repair tools are used in golf primarily to repair pitch marks on the green, that is, ball divots. For this purpose, the tool is moved in the grass surface of the green using lifting and twisting movements.

According to a preferred embodiment for the invention, the divot repair tool is arranged within a tool guide in the body element. The body element has two external side shells, between which essentially parallel plates are arranged. In the manner according to the invention, the divot repair tool is arranged in a lengthwise sliding manner in a plate which is designed as a tool guide plate and arranged essentially parallel to a side shell. Thus the repair tool can be pushed out on a narrow side surface of the pocket tool. In an advantageous manner, an operating pin is mounted on the divot repair tool, arranged essentially perpendicular to the guide plate and projecting through one of the side shells. This operating pin can thus be gripped from one of the side shells and slid lengthwise, whereby the repair tool is also slid lengthwise. Preferably the repair tool can be automatically locked in the body element both in the carrying position drawn into the body element and in the functional position extending out of the body element. For this purpose it is proposed according to the invention to arrange a locking plate parallel to the guide plate which has locking grooves into which the spring-elastic element of the divot repair tool can lock. This spring-elastic element can be the operating pin designed in a spring-elastic manner on the divot repair tool, with the spring elasticity acting perpendicular to the guide plate. The operating pin call be pressed in from the side shell in a spring-elastic manner by pressure and thus press a locking element, which is connected elastically with the divot repair tool, out of a locking groove. In the side shell, according to an advantageous proposal for the invention, a lengthwise groove is designed, in which the operating pin is guided. The lengthwise groove can be carried out at the base of a depression designed in the side shell, so that an operating button set on top of the operating pin is led in this depression. By use of the spring-elastic element on the divot repair tool, therefore, no separate spring is needed for locking the divot repair tool in different positions. The fork guidance can be a guide plate with recesses for the divot repair tool. The guide plate can also be formed by individual elements, however. Thus two or more individual guide elements can be combined to form a guide plate. Two identical elements can be aligned in reflection to the lengthwise median and form a guide area for the divot repair tool. The divot repair tool is designed as a plate-shaped element. This element can preferably be formed from stainless steel. In this way, the divot repair tool can be kept very thin, for example $\leqq 1$ mm, so that a light and above all delicate insertion into the precious lawns of the golf course can be guaranteed. Moreover, the plate-shaped element can be moved through an opening slot which has very narrow tolerances with respect to the divot repair tool. In this way, the opening slot functions as a stripper for sand, dirt, and the like which is on the divot repair tool.

According to another advantageous proposal for the invention, the multiple purpose golf tool has a ball marker. Ball markers are usually plate or coin-shaped plates which are inserted into the green to mark the position of a ball. According to an advantageous proposal for the invention, the ball marker is removably inset into a side shell. For this purpose, the side shell can have a plate-shaped recess in which the ball marker is positioned. In order to arrange the ball marker on the pocket tool in a way that it cannot be lost, it is proposed that the side shell and at least a part of the plates have a groove open from one side edge, into which the holding pin arranged on the ball marker can be inserted. According to an advantageous proposal for the invention, one of the plates can be designed in a spring-elastic manner in the area of the receptacle groove for the holding pin of the ball marker, so that the ball marker can be locked in the position of insertion in the pocket tool. Preferably the spring-elastic area for the holding pin of the ball marker is designed in the guide plate for the divot repair tool. Thus for the ball marker as well, no additional spring is required. The ball marker can be pushed out of the body element with one hand and placed in the desired position at the same time. In order to improve the pushing out of the ball marker, it can be provided that an operating depression is designed in the side plate of the body element. Alternatively, it is also possible not to arrange the ball marker on the tool by pinching of the holding pin, but rather for example to design the ball marker only as a plate-shaped element which can be elastically inset in a recess or depression of the side shell. The elastic force can act for example on the perimeter of the ball marker. A design of this type is economically less expensive.

Both the ball marker and the operating button for the divot repair tool are preferably arranged in the same side shell and can both be operated with one hand. Due to the lengthwise guidance of the divot repair tool, it is also designed to absorb leverage and torsion forces to a limited degree. For this purpose, the end which remains in the body element in the functional position is precisely led and held fast between two plates and the two hardened side guides for the divot repair tool.

Because in hard or frozen soils, the tees cannot easily be placed, a new kind of tool in the form of a tee hole puncher is arranged on the pocket tool in another advantageous proposal for the invention. It is preferably positioned as a swingable functional element against the force of a spring, swingable between a carrying position collapsed into the body element and a functional position extended out of the body element. The spring serves to provide a holding force against inadvertent extension in the Carrying position on the one hand, and a spring force against inadvertent collapse in the functional position. In a manner which is known per se, the functional element is moved with its talon across from a leaf spring. In the invention, in order to improve the holding force, it is proposed that the movement edge between the talon of the functional element and the leaf spring is designed as a locking cam/cam depression pair. While at least one locking cam is positioned on one of the two elements, the other element can have a cam depression, positioned so that in the desired end position the cam is locked in the cam depression. This provides an increased holding force. In an advantageous manner, a cam is designed on the talon of the tee hole puncher, which locks into a cam depression on the leaf spring in the extended position. Meanwhile the cam depression can preferably be designed on the spring at one of the ends of the guiding lane. In an advantageous manner, one cam each is designed on the talon of the tee hole puncher both for the carrying position and for the functional position, which work together with respective cam depressions on the spring. In this way the respective holding forces can be controlled and pre-set by the dimensioning of the cams and the cam depressions, so that even when the spring becomes fatigued, a still adequate holding force for the functional element is provided. The tee hole puncher, which is used to bore holes in the ground surface, is thus protected against unintended collapse during use.

The tee hole puncher can in an advantageous manner be complemented by additional functional elements, for example a cap opener or the like. One lengthwise edge of the tee hole puncher is ground sharp, while the other lengthwise edge is U-bent in a rounded manner to stiffen the punch. The lengthwise flute created in this way is designed as a very practical nail file. The tip of the tee hole puncher is shaped in such a way that it can be used to clean the golf club flutes. Furthermore, additional functional elements such as a knife blade, scissors, and the like can be arranged as swingable functional elements in the pocket tool according to the invention. In these as well a locking cam/locking depression arrangement can be designed in an advantageous manner between the talon and the spring. The multiple purpose golf tool according to the invention can also have removable functional elements like pincers, tooth picks, ball-point pens and the like, for which the side shell, in which the operating button for the pitch fork is not led, is preferably suitable.

The body element is preferably ergonomically shaped. In order to be well usable, it is important that the ball marker and the divot repair tool are operable with one hand. For this purpose, the multiple purpose golf tool must lie well in the hand in general, while the operation of the elements is preferably done with the thumb. In order to insert the divot repair tool and, as the case may be, the tee hole puncher as well, into the ground and to move it there, the tool preferably also has back-grippable areas, so that in the lengthwise direction as well a force can be applied well with application of the necessary feeling. This demand is initially opposed to the desire of being able to design the multiple purpose golf tool overall to be as small as possible. In the collapsed position, usually many functional pieces sit on the side of the multiple purpose golf tool so that they are grippable and extendible with the finger tips. According to the invention it is proposed to be able to insert these functional elements into the body element elastically in order to generate the external ergonomic shape of the body element. After release, the functional elements move back into their normal position, in which they are grippable and extendible.

With the invention, a pocket tool with functional elements for the sport of golf is provided which is economically manufacturable and simple to use, in particular one that is usable with one hand. The divot repair tool arrangement in particular allows the application of slight leverage and torsion forces, which is functionally necessary. The design of locking cams and locking depressions between the tee hole puncher and the corresponding spring increases the operation safety and improves the functionality, since in particular an unintended collapsing of the tee hole puncher during use is largely avoided. To improve the economic viability, the invention proposes one more improvement of the springs. While conventionally the springs have to be counterpositioned across from counterpositioning elements on the plates, the springs now have cams at suitable places which can be counterpositioned against the cams on adjacent springs. In this way, specific counterpositioning points in the intermediate plates can be largely given up.

Further advantages and features of the invention are found in the following detailed description of the invention taken in conjunction with the accompanying drawings.

BRIEF DESCRIPTION OF THE DRAWINGS

FIG. 2 shows an embodiment of a locking cam/cam depression arrangement between the blade talon and the spring.

DETAILED DESCRIPTION OF THE INVENTION

Figure 1:
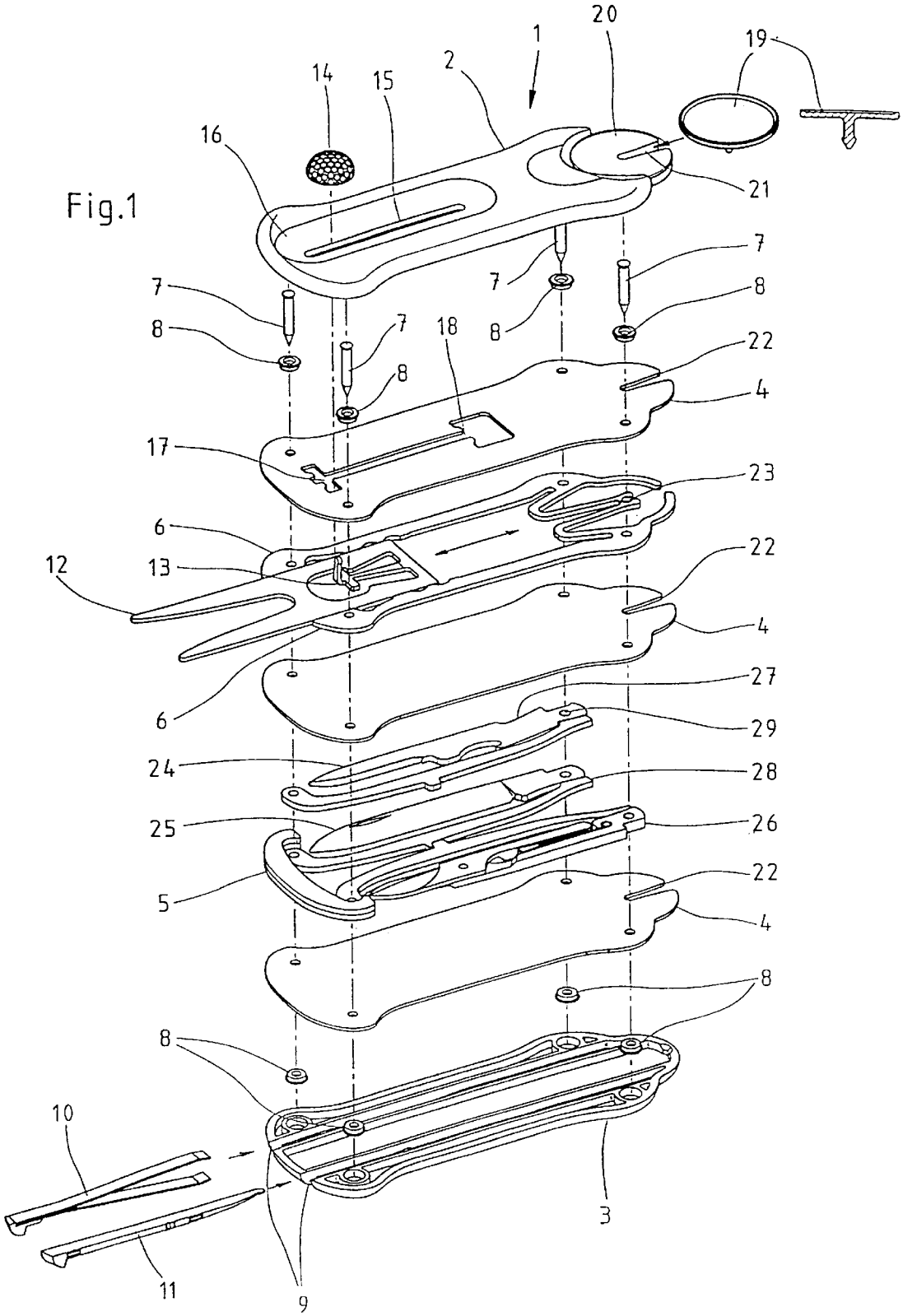
FIG. 1 shows an exploded view of an embodiment of a pocket tool with functional elements suitable for the sport of golf.

FIG. 1 shows in an exploded view, the individual elements of a pocket tool (1). The upper and lower surface of the pocket tool are formed by side shells (2, 3), preferably made of plastic. Between these, parallel to the internal surfaces of the side shells, intermediate plates (4) are arranged, and between the latter functional plates (5, 6) with functional elements. In a manner which is known per se, the plates and side shells are connected by means of clinch pins (7) and clinch rings (8). In lower side shell (3), lengthwise running grooves (9) are designed in the inner surface into which a pincer (10) and a tooth pick (11) can be inserted in a removable manner. The grooves are closed by intermediate plate (4) which is placed on top. In functional plate (6), a divot repair tool (12) is led. The functional plate (6) is formed by guide tracks on the side, in which divot repair tool (12) can be slid lengthwise. The guide tracks are formed by two identical elements aligned in reflection to the lengthwise median of the body element. These are preferably stampings. The guide tracks have recesses along the guide lane in order to keep the frictional forces as low as possible. The two guide tracks, as well as intermediate plates (4) arranged above and below the divot repair tool, form a front guide slot, through which divot repair tool (12) is pushed out of the body element and drawn back into it. Guide plates (4) and guide tracks (6) are arranged as closely as possible to plate-shaped divot repair tool (12) —which is preferably formed of stainless steel —so that they can serve as strippers for the dirt, soil and the like found on the divot repair tool when the divot repair tool is drawn in. In the embodiment shown, the divot repair tool (12) has an operating pin (13) generated by bending and stamping. The essentially T-shaped punch-out is bent up on the free end to create the operating pin. The operating pin can be slotted and provided with a locking head so that an operating button (14) can be stuck on it. The operating button has a surface like a golf ball according to the proposal. Operating button (14) is led in a depression (16) in upper shell (2). It sits on operating pin (13), which projects through a lengthwise groove (15) in upper shell (2). As can be seen in the depicted embodiment, the free end of operating pin (13) is bent up toward upper shell (2). To it is attached a cross bridge, to which in turn is attached a spring arm, which is bent slightly upward. Locking grooves (17) and (18) are designed in intermediate plate (4) lying above this. In the assembled state, the divot repair tool (12) can be simply slid back and forth, with operating pin (13) being pressed to the level of the divot repair tool (12) against the spring elasticity by light pressure on operating button (14), so that the divot repair tool (12) can be slid forward until operating pin (13) hits against locking groove (17). If operating button (14) is now let go, the cross bridge on operating pin (13) is led by spring elasticity into locking groove (17), so that the divot repair tool (12) is locked into its functional position. By the large-surface design of the part of divot repair tool (12) located inside pocket tool (1), the divot repair tool (12) withstands leverage and torsion forces well. By pressure on operating button (14), which continues through operating pin (13), the cross bridge is pressed out of locking groove (17) into the plane of the divot repair tool and the latter can then be moved back to the rear position, where the cross bridge locks behind locking groove (18) in the carrying position of the divot repair tool.

A plate-shaped ball marker, depicted in perspective and in side view, with an only partially visible holding pin, can be laid into a recess (20), in upper side shell (2). Recess (20) can be extended further in a depression form toward depression (16), in order to make it easier to push out ball marker (19) with one hand. It is especially important in this that the overall contour of side shell (2) be completed by it and that the pocket tool is given an especially nicely-shaped exterior. In depression (20) of side shell (2) a groove (21) is designed, which continues in grooves (22) of intermediate plates (4) and also in groove (23) of functional plate (6).

Groove (23) in functional plate (6), formed by two spring arms, serves to clamp in the pin sticking out from ball marker (19). The ball marker can thus be pushed out of the groove with one hand, for example by thumb pressure, and positioned on the desired place. To do this, the force of spring groove (23) must be overcome, when the pin arranged on the ball marker is just being pushed out of groove (21, 22, 23) away from pocket tool (1).

Alternatively, it is also possible not to arrange the ball marker on the tool by clamping in the holding pin, but for example to design the ball marker only as a plate-shaped element, which can be elastically inset into a recess of a depression in the side shell. The elastic force can act, for example, on the perimeter of the ball marker. Such a design is economically less expensive.

The additionally depicted functional plate (5) is formed in a manner known per se by functional elements such as a knife blade (25) or a scissors (26) with a corresponding cover. The cover protects the inside of the tool from dirt. The knife blade includes a blade which can be swung out on the side against the force of a spring, and scissors (26) can also be swung out on the side against the force of a spring. Number (24) designates a tee hole puncher, in which a blade element (27) is positioned in a manner to be swung out on the side against spring (28), and in which in the depicted embodiment the blade element is arranged in parallel to knife blade (25). Blade (27) has a stabbing element provided for forming an essentially vertical hole in the ground, so that a hole for a tee can be made. In the rear area, an additional functional element can be designed, for example a bottle opener or the like, In the rear area of blade (27), the latter is arranged in a swingable manner around axle The rear area is designated as a talon.

The described pocket tool (1) with divot repair tool (12), ball marker (19), and tee hole puncher (24) represents a very attractive-looking tool due to its integrated surface, which can be operated with one hand at least with respect to the divot repair tool and ball marker, and which is extremely functional, providing good service in the sport of golf. The manufacture is economical and the corresponding force absorption is appropriate to the purpose.

In functional plate (5) it can be seen that the two springs (28) are positioned against one another with cams designed about half length. Due to this counterpositioning, corresponding counterpositions on the intermediate plates are unnecessary. In this way it becomes possible in an economical manner to use identical intermediate plates (4) in the depicted embodiment.

FIG. 1 also shows that the middle area of the body element is constricted, so that at least in the head area, from which the divot repair tool can be slid out, a T-shaped widening is designed. In the functional position, these enlargements can be back-gripped. For this purpose, functional elements (24, 25, and 26) are designed so that they can be pressed elastically into the body element, but moved back into their depicted normal position after release. In this way, the especially ergonomic shape of the pocket tool can be supported by the spring-movability of the functional elements.

A special feature for controlling and improving the holding forces of swingable functional elements is shown in FIG. 2. FIG. 2 shows talon (30) of blade (27) which is swingable around axle (29), as well as the corresponding end area of spring (28). In the position of functional element (24) depicted in FIG. 1, blade (27) rests with its rest stopping area (31) on rest stopping area (32) of spring (28). In the depicted embodiment, a cam (33) on blade talon (30) is locked in in a cam depression (34) on the spring. Thus depending on the size of cam (33) and the spring force, there results a corresponding holding force in the carrying position, that is, the collapsed position of the blade. Angle (35), for example between 22° and 37°, determines the force which must be applied in order to leverage cam (33) out of depression (34). Correspondingly, angle (36) must be adjusted to cam depression (34), for example in a range between 20° and 35°. If then the blade is gripped and the holding force is overcome by the expenditure of force, so that cam (33) is lifted out of cam depression (34), movement lane (37) at the extreme end of the blade talon runs through rest stop (32). This crank guide effects a clean swing movement of blade (27) with respect to spring (28). Finally the cam on the talon, designated in the embodiment with number (38), arrives in cam depression (39) on the further spring edge. The height of stop (42) defines the extended blade position. In this cam/depression pair as well, angle (40) at cam (38) on blade talon (30) and angle (41) at cam depression (39) on spring (28) are adjusted to one another, for example both at about 60°. This results in a corresponding holding force of blade (27) in the extended position, so that for example an inadvertent collapse of the blade during use is largely ruled out.

The described embodiments serve only for explanation and are not limiting. In particular, there can also be only one holding cam designed on the end of the blade talon, in order to increase the force in one of the end positions. Also cams can be designed on the spring and cam depressions on the blade talon. Also corresponding crank guides of a similarly functioning type are conceivable.

What is claimed is:

1. A multiple purpose golf tool comprising:

a handle having first and second side shells with a receptacle area therebetween;

a forked divot repair tool shaped and configured for repairing golf course divots and slidably housed in said handle for sliding between a carrying position and a functional position; and a guide plate arranged parallel to and between said first and second side shells, wherein said divot repair tool is inset into the surface of said guide plate.

2. A multiple purpose golf tool as in claim 1, wherein said divot repair tool is arranged in a sliding manner in the lengthwise direction of said housing.

3. A multiple purpose golf tool as in claim 2, wherein:

said guide plate is positioned adjacent to said divot repair tool to remove foreign material from said divot repair tool when said divot repair tool is slidingly moved into said carrying position from a functional position.

4. A multiple purpose golf tool according to claim 1, further comprising an operating pin for said divot repair tool, extending perpendicularly from said divot repair tool and projecting through a side shell of said housing.

5. A multiple purpose golf tool as in claim 1, further comprising a locking plate furnished with locking recesses to lock said divot repair tool into a desired position.

6. A multiple purpose golf tool according to claim 5, further comprising a locking element elastically projecting from said divot repair tool for engagement with said locking plate to lock said divot repair tool into one of said functional position or said carrying position.

7. A multiple purpose golf tool as in claim 6, wherein said divot repair tool is a plate-shaped element.

8. A multiple purpose golf tool as in claim 7, wherein said divot repair tool, said locking element, and said operating pin are designed as one piece.

9. A multiple purpose golf tool as in claim 4, wherein said operating pin is led in a guiding groove in one of said side shells.

10. A multiple purpose golf tool as in claim 1, further comprising a ball marker coupled to said body element and removable with one hand.

11. A multiple purpose golf tool comprising:

a lengthwise body element serving as a handle with a receptacle area therein;

at least one functional element pivotably coupled to said handle for movement between a carrying position in said receptacle area and a functional position outside said receptacle area; and a divot repair tool coupled to said body element for sliding in the lengthwise direction of said body element between a carrying position and a functional position.

12. A multiple purpose golf tool as in claim 11, wherein said at least one functional element is selected from the group consisting of: a knife blade, scissors, bottle opener, and a tee hole puncher.

13. A multiple purpose golf tool as in claim 12, further comprising at least one spring element associated with said at least one functional element, wherein:

said pivotably coupled functional element further comprises a talon;

a locking cam is designed on said talon;

said functional element is positioned with said talon against said spring element;

a guide lane including a cam depression is designed on said spring element; and said locking cam interacts with said guide lane of said spring element.

14. A multiple purpose golf tool as in claim 11, further comprising side shells on said body element formed with channels to hold additional tools.

15. A multiple purpose golf tool as in claim 14, wherein said additional tools are selected from the group consisting of: a toothpick and a pincer.

16. A multiple purpose golf tool comprising:

a lengthwise body element having an ergonomic shape and serving as a handle with a receptacle area therein for storage of one or more functional elements; and a plurality of functional elements pivotably coupled to said body element for movement between a carrying position in said receptacle area and a functional position outside said receptacle area;

wherein when said functional elements are in said carrying position said functional elements are elastically pressable into said receptacle to generate said ergonomic shape of said body element thereby allowing the user to fully grip the ergonomically shaped body element without interference from the functional elements.

17. A multiple purpose golf tool as in claim 16, further comprising a divot repair tool coupled to said body element for movement in a sliding manner in the lengthwise direction of said body element between a carrying position and a functional position.

18. A multiple purpose golf tool as in claim 16, further comprising two springs counterpositioned against each other within said receptacle area, wherein said functional elements are elastically pressable against said springs.

19. A multiple purpose golf tool as in claim 11, wherein said divot repair tool slides between a carrying position in said receptacle area and a functional position outside said receptacle area.

20. A multiple purpose golf tool as in claim 16, wherein:

said body element has a first side and a second side opposite said first side; and at least one of said functional elements is accessible from said first side of said body element and at least one of said functional elements is accessible from said second side of said body element.

21. A multiple purpose golf tool as in claim 19, further comprising a guide plate arranged parallel to and between said first and second side shells, wherein said divot repair tool is inset into the surface of said guide plate.

22. A multiple purpose golf tool according to claim 19, wherein said ball marker is plate-shaped and has a centrally protruding holding pin insertable into a clamping groove in the body element.

23. A multiple purpose golf tool as in claim 20, further comprising a guide plate arranged parallel to and between said first and second side shells, wherein said divot repair tool is inset into the surface of said guide plate.

24. A multiple purpose golf tool as in claim 20, wherein said tee hole puncher is designed as a functional element which can be swung out on the side, having a tip and additional functional areas.

25. A multiple purpose golf tool according to claim 20, wherein:

said tee hole puncher further comprises a talon; and said tee hole puncher is positioned with said talon against a spring element.

26. A multiple purpose golf tool as in claim 25, further comprising:

a locking cam designed on said talon of said tee hole puncher; and a guide lane designed on said spring element;

wherein said locking cam interacts with said guide lane of said spring element.

27. A multiple purpose golf tool as in claim 26, wherein:

said guide lane has a locking depression, in which said locking cam on said talon of said tee hole puncher engages to lock said tee hole puncher into a desired position.

28. A multiple purpose golf tool as in claim 27, wherein said locking cam/locking depression combination is designed to lock said tee hole puncher in a carrying position and in a functional position.

29. A multiple purpose golf tool as in claim 1, wherein said body element has an ergonomic shape and back-grippable areas.

30. A multiple purpose golf tool as in claim 1, further comprising functional elements swingable between a carrying position in said receptacle area to a functional position outside said receptacle area, wherein in their carrying position said swingable functional elements are elastically held with respect to said body element.

* * * * *